United States Patent [19]

Cherry

[11] 4,336,426

[45] Jun. 22, 1982

[54] INERTIA SWITCH

[75] Inventor: Walter L. Cherry, Winnetka, Ill.

[73] Assignee: Cherry Electrical Products Corporation, Waukegan, Ill.

[21] Appl. No.: 184,473

[22] Filed: Sep. 5, 1980

[51] Int. Cl.[3] ..... H01H 35/14

[52] U.S. Cl. ..... 200/615

[58] Field of Search ..... 200/61.45 R, 61.48, 200/61.5, 61.52, 61.53

[56] References Cited

U.S. PATENT DOCUMENTS

| | | | |
|---|---|---|---|
| 2,176,770 | 10/1939 | Maught | 200/61.5 |
| 2,188,144 | 1/1940 | Eytman | 200/61.5 |
| 3,066,202 | 11/1962 | Kaleba et al. | 200/61.52 X |
| 3,333,073 | 7/1967 | Ohlson | 200/61.5 X |
| 3,518,385 | 6/1970 | Boudes et al. | 200/61.45 R |
| 3,601,563 | 8/1971 | Serpette et al. | 200/61.5 |
| 3,745,277 | 7/1973 | Shawcross et al. | 200/61.5 |

FOREIGN PATENT DOCUMENTS

| | | | |
|---|---|---|---|
| 1445690 | 8/1976 | United Kingdom | 200/61.5 |

*Primary Examiner*—Gene Z. Rubinson

*Attorney, Agent, or Firm*—Hume, Clement, Brinks, Willian & Olds, Ltd.

[57] ABSTRACT

An inertia switch including a cone-shaped inertia mass element movable from a stable condition wherein it supports a movable switch plunger in a position for maintaining a pair of switch blades in an open condition, into a collapsed condition in response to an impact bringing about an abrupt change in movement. In the collapsed condition the inertia mass will be out of its plunger supporting position allowing the same to activate the switch by permitting the switch blades to close.

10 Claims, 7 Drawing Figures

INERTIA SWITCH

SUMMARY OF THE INVENTION

This invention relates to an inertia switch apparatus responsive to abrupt changes in movement occurring in any direction through the horizontal plane. Many prior so-called inertia switches are restricted to actuation in limited direction movement or limited changes in velocity and thus are not universally adaptable.

The present invention utilizes as its inertia element a cone-shaped member. From this configuration, the inertia mass is located at a point between the cone's circular base and its apex, permitting the cone to pivotally respond uniformly to an impact force coming from any direction in the horizontal plane.

The switch controlling plunger provides an external releasable latch arrangement whereby the device will remain in its actuated condition until manually reset.

Resetting is achieved by applied compression forces upon external portions of the plunger carrier and a directional pull out of its latched position.

GENERAL DESCRIPTION

Figure 6:
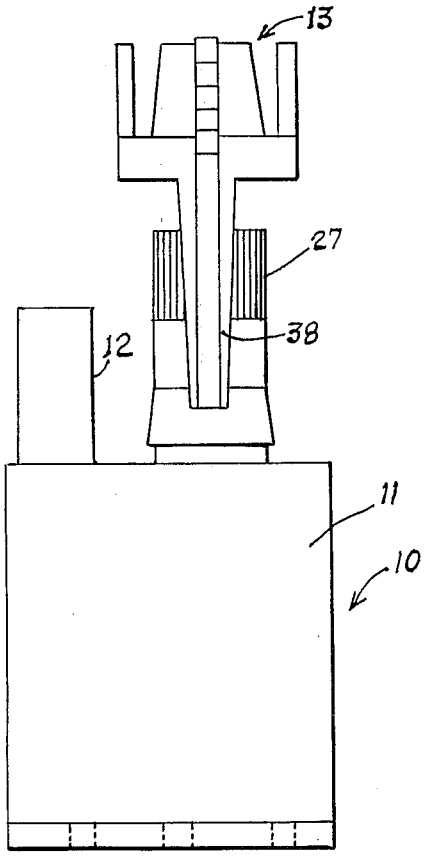
FIG. 6 is a side elevational view of the inertia switch of this invention.

FIG. 6 is a side elevational view showing the inertia switch 10 of this invention as including a housing 11, an electrical connector compartment 12, and an external plunger carrier 13.

Figure 1:
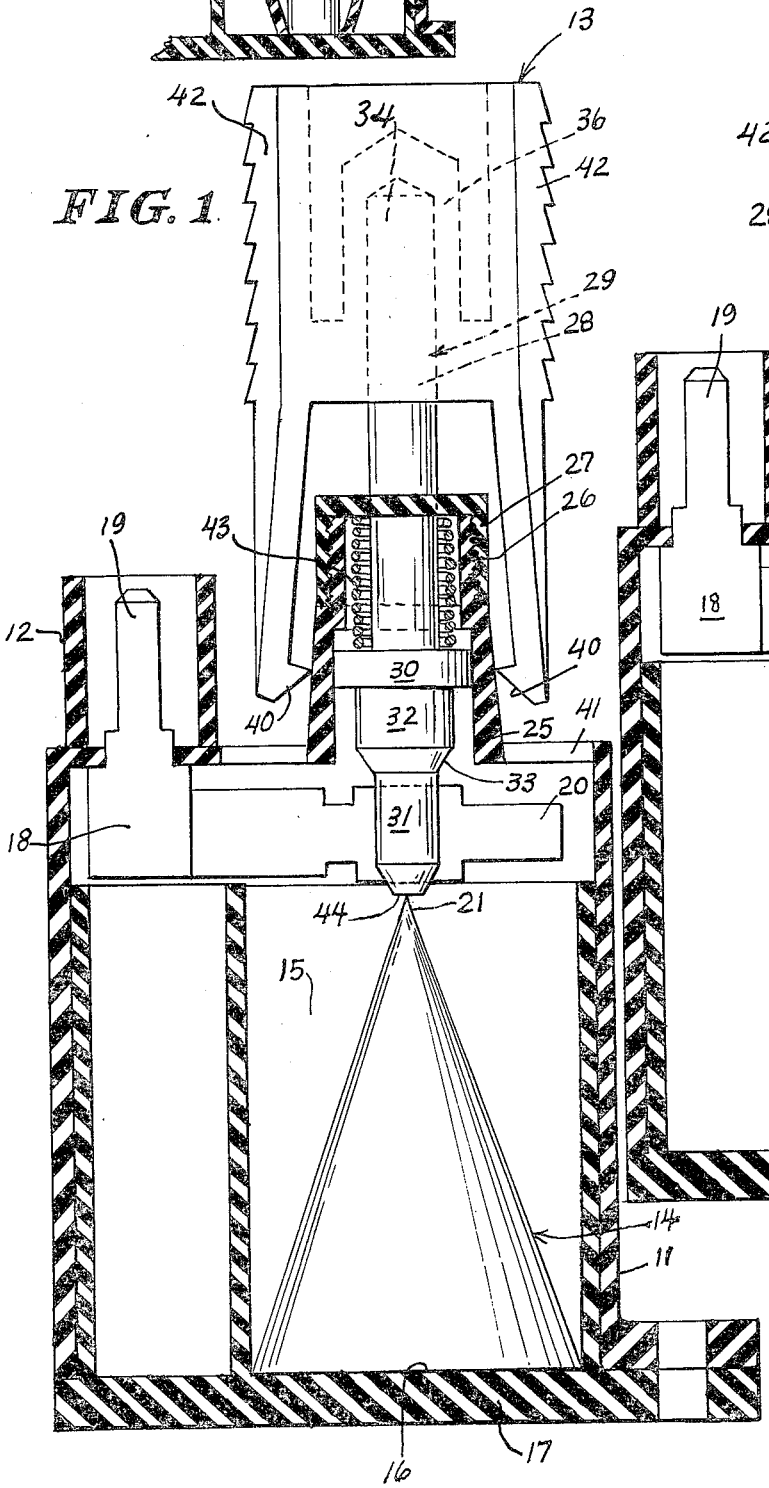
FIG. 1 is a side detailed sectional view of the inertia switch of this invention in its unactuated position.

FIG. 1 shows the components of the inertia switch 10 as including an inertia mass element 14 in the form of a cone. The cone 14 is contained within a circular compartment 15, and in its normal position as seen in FIG. 1, the cone's circular base 16 rests upon the bottom wall 17 of the housing 11.

Within the upper portion of the housing 11 and in communication with the electrical connector compartment 12 is an electric switch 18 having its external connectors 19 disposed in the electrical connector compartment 12, while its switch blades 20 extend in a transverse direction to the apex 21 of the cone 14.

Provided by the top wall of the housing 11 is a hollow sleeve 25, which extends in a spaced paralled direction with respect to the electrical connector compartment 12. The upper free end portion of the sleeve 25 is externally threaded as at 26 for the purpose of receiving an adjustment nut 27.

Figure 5:
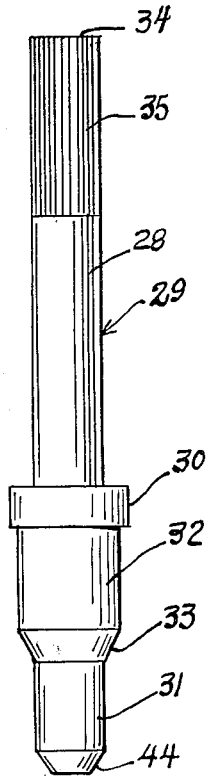
FIG. 5 is an elevational view of the switch plunger.
Figure 4:
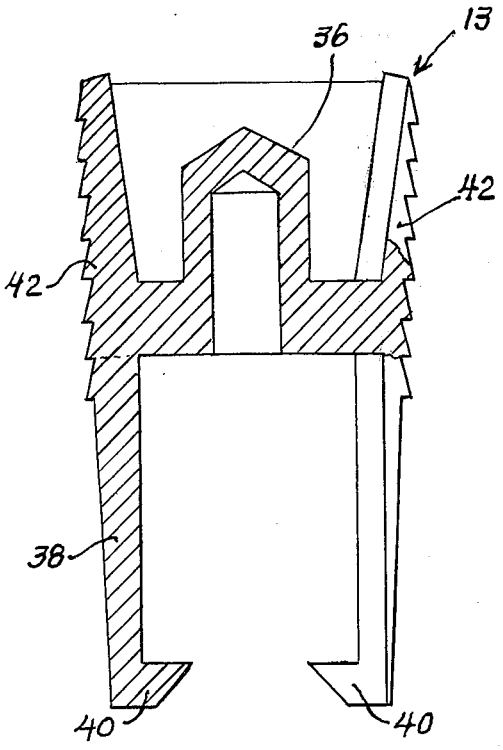
FIG. 4 is a side elevational detailed sectional view of the switch plunger carrier.

Adapted to be journalled through the sleeve 25 as well as the adjustment nut 27 is the elongated shank portion 28 of a plunger 29. The plunger 29 includes a circular collar 30, and has to one side thereof an elongated, somewhat smaller circular section 32. The section 32 is adjacent to a reduced circular end 31, and separated therefrom by an inclined wall 33. The opposite end 34 of the plunger 29 is knurled as at 35 (see FIG. 5), and as such is press fitted into a circular receptacle 36 provided by the external plunger carrier 13. The plunger carrier 13 includes a pair of elongated relatively thin latch legs 38, which extend substantially coaxially with respect to the plunger 29. The free ends of the legs 38 provide inwardly directed hook elements 40, which are adapted to be moved into the housing 11 through openings 41 formed in the top wall thereof. The opposite ends of the latch legs 38 provide independent grip arms 42. It is desirable that the external plunger carrier 13 be made from a semi-rigid plastic material so that by external compression forces against the grip arms 42, there will be a slight separational movement of the latch legs 38 for a purpose hereinafter made apparent.

Within the sleeve 25 and extending between the collar 30 on the plunger 29 and the inner wall of the adjusting nut 27 is a coiled expansion spring 43. This expansion spring 43 tends to yieldably urge plunger 29 and its carrier 13 in a direction of the housing 11 and through the open wall 41 formed in the top wall thereof.

The inertia switch 10 is adapted to be fixedly mounted to any object for which it is desired to monitor abrupt changes in movement or impact, and as such would be placed in the condition as shown in FIG. 1.

Figure 2:
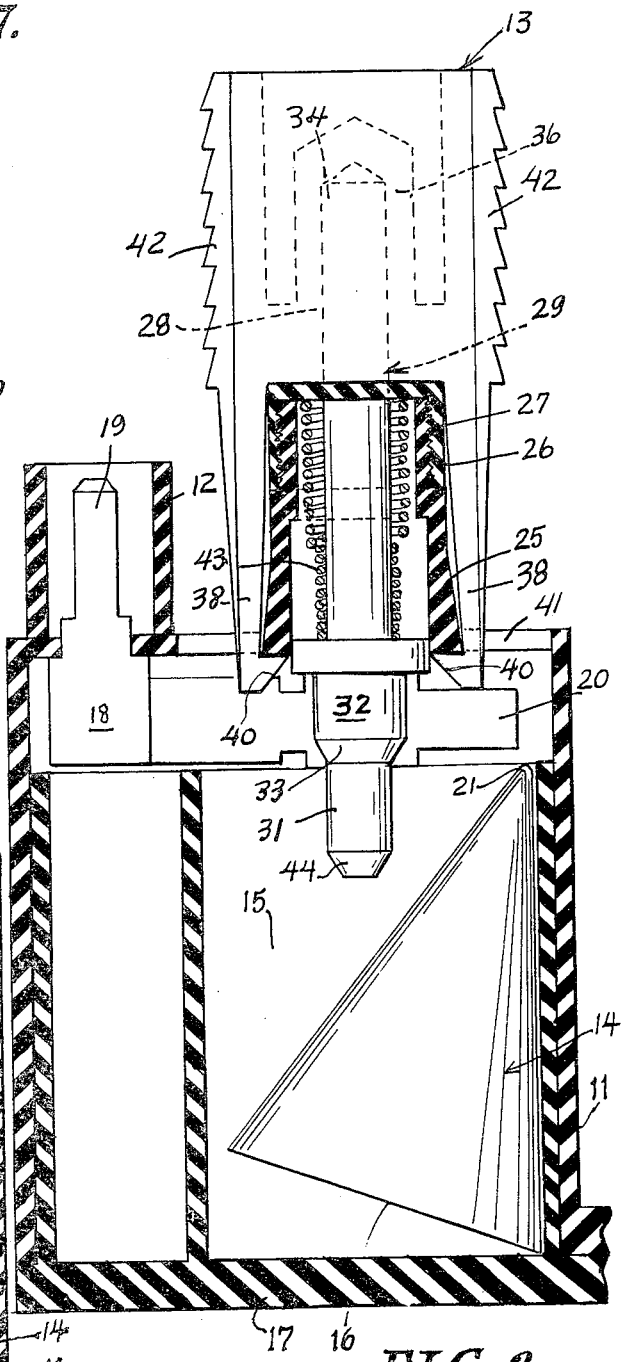
FIG. 2 is a side sectional detailed view of the inertia switch in its actuated position.
Figure 3:
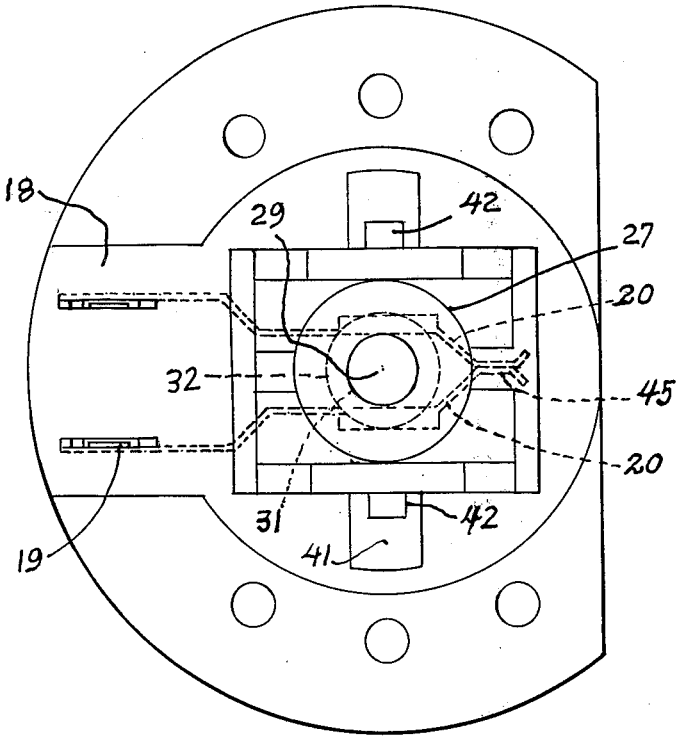
FIG. 3 is a top plan view of the invention showing certain portions thereof in dotted lines.

In FIG. 1 the inertia mass element or cone 14 is properly seated within the compartment 15 with its circular base 16 in contact with the bottom wall 17 of the housing 11. The apex 21 of the cone 14 engages the free inner end 44 of the plunger 29. In this position the cone 14 resists longitudinal movement of the plunger 29 as it is normally urged by the expansion spring 43. In such position of the plunger 29 the reduced end 32 permits the switch blades 20 to have their free ends 45 (see FIG. 3) in facial contact. In this condition the switch 18 is energized and may be part of a control circuit not shown. When the switch housing 11 is subject to an abrupt change in velocity resulting from an impact or the like the inertia mass 14 will become unstabled and assume a tilted position such as is shown in FIG. 2. As the apex 21 of the cone 14 moves from beneath the plunger 29 it, together with the plunger carrier 13, is permitted to move through its longitudinal axis inwardly of the housing 11. The enlarged section 32 of the plunger 29 will be forced to pass between the switch blades 20 causing the same to open, de-energizing the switch 18. The hook portions 40 of the latching legs 38 will move through the opening 41 formed in the top wall of the housing 11 and engage the bottom wall of the sleeve 25. In this position there is a visual indication that the inertia switch has been activated.

To reset the inertia switch one need only grip the gripping arms 42 and compress the same together, which will result in an outward flexing of the latching legs 38, so that the hook elements 40 become disengaged from the sleeve 25. The plunger carrier 13 together with the plunger 29 may be withdrawn outwardly of the housing 11. By this movement the inertia mass or cone 14 is permitted to assume its normal condition as shown in FIG. 1 and the inertia switch will be reactivated.

Figure 7:
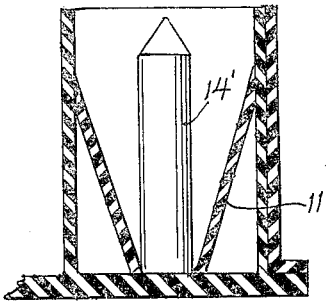
FIG. 7 is a modified form of the inertia switch.

Reference is made to FIG. 7 which illustrates a modified form of the inertia switch. The modification relates to the inertia mass element 14 prime which is shown to be positioned within the switch housing within a compartment having inwardly tapered side walls 11 prime. The inertia mass 14 prime will become unstable and move from beneath the plunger tip 44 upon impact and momentarily be displaced to one side thereof, permitting the switch to be activated. By reason of its length when the plunger 29 is retracted outwardly of the switch housing, the inertia mass 14 prime will seek to right itself into its set position as shown. The modified inertia mass 14 prime has the same action as the cone shaped inertia mass 14 shown in the preferred form of embodiment.

While I have illustrated and described the preferred form of construction for carrying my invention into effect, this is capable of variation and modification without departing from the spirit of the invention. I, therefore, do not wish to be limited to the precise details of construction as set forth, but desire to avail myself of such variations and modifications as come within the scope of the appended claims.

Having thus described my invention what I claim as new and desire to protect by Letters Patent is:

1. An inertia switch comprising:

(a) a hollow housing providing an internal circular compartment, (b) a switch plunger having a first and a second end, movable within said housing, (c) means normally urging said plunger for movement in one direction within said housing from a retained position into an activating position, (d) an electric switch within said housing and having a pair of switch blades normally biased into contact with each other with said switch blades disposed in the path of movement of said first end of said plunger, (e) an inertia mass within said housing which, when in its stable condition, is in contact with said first end of said plunger for resisting movement of said plunger in one direction within said housing and for maintaining it in its retained position, (f) said inertia mass responsive uniformly to any impact force upon said housing in any direction through the horizontal plane for unstabilizing said inertia mass and moving it out of the path of said plunger, permitting said plunger to move into its activating position so as to effect separation of said switch blades and de-energization of said switch, and (g) a carrier mounted to said plunger, having means for releasably latching said plunger into its activating position when said inertia mass has been moved into its unstabilizing position, and further having means for manually unlatching said latching means to release said plunger from its activating position to allow the same to return to its retained position as said inertia mass is returned to its stable condition.

2. An inertia switch as defined by claim 1 wherein said means normally urging said plunger for movement in one direction comprises an expansion spring positioned between a portion of said movable plunger and said housing.

3. An inertia switch as defined by claim 1 wherein said inertia mass comprises a cone-shaped element, the circular base of which is adapted to sit on the floor of said circular compartment within said housing, and having its apex in contact with one end of said switch plunger.

4. An inertia switch as defined by claim 1 wherein said inertia mass comprises a rod-shaped element having one end thereof cone-shaped, the circular base of which is adapted to sit on the floor of said circular compartment within said housing, and having its cone-shaped end in contact with one end of said switch plunger, and wherein said switch housing has inwardly tapered side walls to form a partially conically-shaped internal circular compartment.

5. An inertia switch as defined by claim 1 wherein said latching means comprise hook means connected to said unlatching means, and wherein said housing includes means for engaging said hook means.

6. An inertia switch as defined by claim 5 wherein said unlatching means comprise grip means, the manual manipulation of which disengages said hook means from said engaging means.

7. An inertia switch defined by claim 1 wherein said carrier further comprises an element forming a receptacle for said second end of said plunger, wherein the latching means and the unlatching means comprise two latch legs extending along said plunger, each leg defining at one end a hook and defining at the other end a grip arm, said legs pivotably mounted along their length to said receptacle-forming element such that flexing of said grip arms pivots the hooks to release said carrier and said plunger, and wherein said housing includes means for releasably engaging said hooks.

8. An inertia switch defined by claim 7 wherein said engaging means include a wall of said housing defining openings therein aligned with said hooks and adapted to allow said hooks to pass therethrough to engage said housing wall.

9. An inertia switch defined by claim 1 wherein said housing defines two openings within its wall adjacent said plunger, and wherein said carrier latching and unlatching means comprise an element mounted to said second end of said plunger and extending outwardly therefrom, a pair of latch legs extending along said plunger, each leg defining at one end a hook facing the hook defined by the other leg and positioned over one of said openings defined by said wall of said housing when said plunger is in a retained position, said hook extending through one of said openings and engaging said wall of said housing when said plunger is in an activating position, each leg further defining at the other end a grip arm adapted to be manually manipulated, said legs flexibly mounted along their length to said element such that flexing of said grip arms toward each other pivots the hooks away from each other to disengage said hooks from said wall of said housing, and pulling of said grip arms in a direction away from said housing allows said inertia mass to resume said stable condition.

10. An improved inertia switch comprising:

(a) a hollow housing forming a cylindrical compartment, a hollow sleeve extending above and communicating with said cylindrical compartment, and a wall of said housing defining two openings adjacent said sleeve;

(b) a switch plunger having an elongated shank portion journalled through said sleeve, and a first and a second end portion, said first end portion extending into said housing and defining a circular collar, a circular section adjacent said circular collar, and a circular end adjacent said circular section and having a diameter different from the diameter of said circular section;

(c) a coiled compression spring mounted around said shank portion and extending between a wall of said sleeve and said circular collar for movably urging said plunger into said housing from a retained position into an activated position;

(d) an electric switch, including a pair of switch blades mounted in said housing extending trasversely to said plunger and having said first end portion of said plunger extend between them, said blades assuming a closed position when one of said circular end and said circular section is positioned between them and assuming an open position when the other of said circular end and said circular section is positioned between them;

(e) a substantially conically shaped elongated inertial mass element positioned in said cylindrical compartment, said element normally assuming a stable position in which said mass element contacts said first end portion of said plunger to support said plunger in a retained position;

(f) said mass element responsive to abrupt acceleration of said switch in a direction substantially transverse to the length of said mass element to assume an unstable position in which said mass element tilts out of contact with said plunger to allow said plunger to assume an activated position; and (g) a plunger carrier mounted to said second end of said plunger, said plunger carrier having an element fitted to said second end of said plunger and extending outwardly therefrom, a pair of latch legs extending along said plunger, each leg defining at one end a hook facing the hook defined by the other leg and positioned over one of said openings defined by said wall of said housing when said plunger is in a retained position, said hook extending through one of said openings and engaging said wall of said housing when said plunger is in an activated position, each leg further defining at the other end a grip arm adapted to be manually manipulated, said legs flexibly mounted along their length to said element such that flexing of said grip arms toward each other pivots the hooks away from each other to disengage said hooks from said wall of said housing, and pulling on said grip arms in a direction away from said housing allows said inertial mass to reassume said stable position.

* * * * *

UNITED STATES PATENT AND TRADEMARK OFFICE

CERTIFICATE OF CORRECTION

PATENT NO. : 4,336,426

DATED : June 22, 1982

INVENTOR(S) : WALTER L. CHERRY

It is certified that error appears in the above—identified patent and that said Letters Patent is hereby corrected as shown below:

At column 3, line 9, before "embodiment", insert --the--.

At Claim 10, line 21, delete "tras" and insert --trans--.

Signed and Sealed this

*Twenty-fifth* Day of *January 1983*

[SEAL]

*Attest:*

GERALD J. MOSSINGHOFF

*Attesting Officer*

*Commissioner of Patents and Trademarks*